US005376864A

United States Patent [19]

Hudson et al.

[11] Patent Number: 5,376,864

[45] Date of Patent: Dec. 27, 1994

[54] SHIELDED SERPENTINE TRAVELING WAVE TUBE DEFLECTION STRUCTURE

[75] Inventors: Charles L. Hudson, Santa Barbara; Jerome Spector, Berkeley, both of Calif.

[73] Assignee: The United States of America as represented by the Department of Energy, Washington, D.C.

[21] Appl. No.: 968,630

[22] Filed: Oct. 29, 1992

[51] Int. Cl.[5] ..... H01J 23/10

[52] U.S. Cl. ..... 315/3; 315/5/24; 313/421

[58] Field of Search ..... 315/3, 5.24–5.26, 315/7, 8; 313/421, 431

[56] References Cited

U.S. PATENT DOCUMENTS

| | | | |
|---|---|---|---|
| 3,280,361 | 10/1966 | Goldberg et al. | 315/3 |
| 3,504,222 | 3/1970 | Fukushima | 315/3 |
| 3,696,266 | 10/1972 | Nishino et al. | 315/3 |
| 3,849,695 | 11/1974 | Piazza et al. | 315/3 |
| 3,878,532 | 4/1975 | Buck | 315/3 X |
| 4,207,492 | 6/1980 | Tomison et al. | 315/3 |
| 4,507,586 | 3/1985 | Correll | 315/3 |
| 4,894,628 | 1/1990 | Dadswell | 333/160 |
| 5,172,029 | 12/1992 | Norris et al. | 315/3 |
| 5,210,464 | 5/1993 | Dunham et al. | 315/3 |

FOREIGN PATENT DOCUMENTS

| | | | |
|---|---|---|---|
| 1394438 | 5/1975 | United Kingdom | 315/3 |

*Primary Examiner*—Benny T. Lee

*Attorney, Agent, or Firm*—Miguel A. Valdes; Roger S. Gaither; William R. Moser

[57] ABSTRACT

A shielded serpentine slow wave deflection structure (10) having a serpentine signal conductor (12) within a channel groove (46), The channel groove (46) is formed by a serpentine channel (20) in a trough plate (18) and a ground plane (14). The serpentine signal conductor (12) is supported at its ends by coaxial feed through connectors 28. A beam interaction trough (22) intersects the channel groove (46) to form a plurality of beam interaction regions (56) wherein an electron beam (54) may be deflected relative to the serpentine signal conductor (12).

13 Claims, 3 Drawing Sheets

SHIELDED SERPENTINE TRAVELING WAVE TUBE DEFLECTION STRUCTURE

The invention described herein arose in the course of, or under, contract No. DE-AC08-88NV10617 between the United States Department of Energy and E. G. & G. Energy Measurements.

BACKGROUND OF THE INVENTION

The present invention relates generally to high bandwidth cathode ray tubes, and more particularly to an improved slow wave deflection structure for use in traveling wave deflection systems.

Traveling wave devices are well known in the art. Traveling wave devices address the problem that, since it takes an electron beam a finite amount of time to travel from a source electrode to a destination in an electron tube, that beam cannot be accurately deflected to reflect variations in a modulating source which occur within that finite time. The solution provided by traveling wave devices is that wave deflection forces be made to "travel" along with electrons on their traverse between the emission source and the destination.

In traveling wave cathode ray tubes, a slow wave delay device is necessary for delaying deflection signals such that a traveling deflecting field which approximates the speed of the electrons to be deflected is produced. The slow wave device generally takes the form of a deflection structure which causes the signal to meander along a circuitous path, and such deflection structures have generally taken the form of helices or serpentines. Several variations of slow wave deflection structures are known in the prior art. An example is the variation taught by U.S. Pat. No. 3,504,222, issued to Fukushima. The Fukushima invention improves the dispersion characteristics of traveling wave tubes which employ the teachings of that invention.

A problem of particular concern in the operation of traveling wave cathode ray tubes is that caused by fields which are not confined to the helical or serpentine transmission line, but are coupled, instead, between turns of the helix or serpentine or are transmitted by higher velocity modes in space between the helix and ground planes. These fast fields deflect the electron beam at a point on the beam where no deflection should occur, and cause an erroneous signal to appear where there should be none. This particular erroneous signal is called a "precursor" artifact. The problem which causes the precursor artifact is more serious and detrimental in high bandwidth cathode ray tubes, because the high frequency components of these signals are preferentially coupled along the structure of the slow wave device.

It is known in the prior art that precursor signals can be eliminated by means of specialized helical structures or by interposing grounded metal fins between the adjacent bars of serpentine slow wave structures. However, the simple imposition of grounded metal fins does not prevent the appearance of resonances caused by characteristic impedance discontinuities at the "loops" of the serpentine, nor does it provide a discontinuity-free transmission line necessary for propagation of high fidelity and high bandwidth signals.

No prior art slow wave device, to the inventors' knowledge, has successfully provided an effective means for producing a delayed deflection signal which both eliminates fast forward coupling and is free from discontinuities. All prior art means for producing slow wave deflection signals using serpentine deflection structures have either not eliminated fast forward coupling and/or have not provided a discontinuity-free transmission line.

SUMMARY OF THE INVENTION

Accordingly, it is an object of the present invention to provide a slow wave deflection structure which eliminates fast forward transmission and precursor artifacts.

It is another object of the present invention to provide a slow wave deflection structure which incorporates an easily modifiable transmission line to correct for characteristic impedance changes associated with the high radius-of-curvature loops characteristic of serpentine deflection structures.

It is still another object of the present invention to provide a a slow wave deflection structure which is mechanically rugged.

It is yet another object of the present invention to provide a slow wave deflection structure which does not introduce capacitive/inductive discontinuities which perturb the transmitted signal therein.

It is still another object of the present invention to provide a slow wave deflection structure which can be reliably and economically manufactured.

Briefly, the preferred embodiment of the present invention utilizes known "trough transmission line" technology which, in combination with the other unique aspects of the invention, forms a serpentine slow wave deflection device which has a serpentine groove machined into a ground channel structure with a serpentine conductor running therethrough. No additional support, other than the end connections, is required of the serpentine conductor within the serpentine groove such that there is no source of inductive or capacitive discontinuity along the length of the conductor. Signal is transmitted to the serpentine conductor from a source via a feedthrough port, and a channel is cut through the channel structure to provide a plurality of interaction areas wherein the delayed slow wave signal can interact with the electron beam to be deflected. Experiments have shown that only an insignificant amount of fast forward coupling occurs within these small interaction areas.

An advantage of the present invention is that fast forward coupling, and the resultant precursor artifact, are eliminated.

A further advantage of the present invention is that characteristic impedance changes associated with the high radius-of-curvature loops characteristic of serpentine deflection structures may be corrected.

Yet another advantage of the present invention is that the serpentine structure needs be supported only at its ends, and does not require additional supporting structures which would cause electrical discontinuities.

Still another advantage of the present invention is that it does not introduce capacitive/inductive discontinuities to perturb the transmitted signal therein.

Yet another advantage of the present invention is that it is rugged and reliable in operation.

These and other objects and advantages of the present invention will become clear to those skilled in the art in view of the description of the best presently known mode of carrying out the invention and the industrial applicability of the preferred embodiment, as described herein and as illustrated in the several figures of thee drawing.

DETAILED DESCRIPTION OF THE INVENTION

The best presently known mode for carrying out the invention is a slow wave deflection structure for a traveling wave cathode ray tube. The predominant expected usage of the slow wave deflection structure of the present invention is as a substitute for prior art slow wave deflection structures in cathode ray tubes used for displaying traces of high frequency signals.

Figure 1:
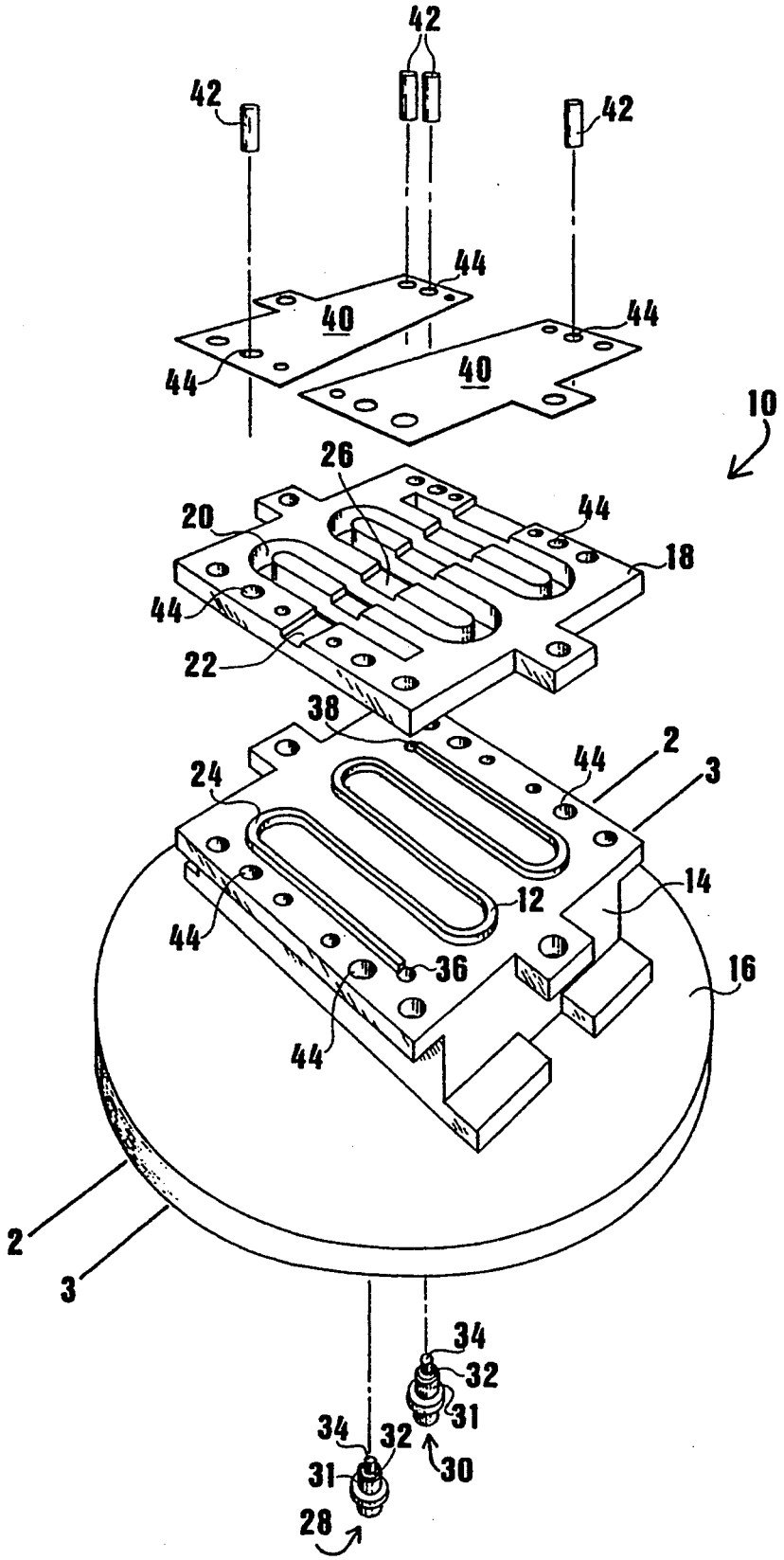
FIG. 1 is an exploded perspective view of a shielded serpentine deflection structure, according to the present invention.

A shielded serpentine deflection structure is shown in an exploded perspective view in FIG. 1, and is designated therein by the general reference character 10. In the best presently known embodiment 10 of the present invention, a serpentine signal conductor 12 is formed to the desired shape by an electro-discharge machine (EDM), or other appropriate tooling. Using this method of fabrication, the serpentine signal conductor 12 will be rectangular in cross section, as is shown in the view of FIG. 1, although this is not a necessary aspect of the present invention. The serpentine signal conductor 12 is mounted above a ground plane 14, as will be discussed in more detail, hereinafter, and the ground plane 14 is, itself, mounted on a base plate 16, as is shown in the view of FIG. 1.

A conducting trough plate 18 is provided for attachment to the ground plane 14, as will be discussed hereinafter. The trough plate 18 has a serpentine channel 20 machined therethrough such that the serpentine signal conductor fits within the serpentine channel 20 when the trough plate 18 is affixed to the ground plane 14. A beam interaction trough 22 is also machined into the trough plate 18. The beam interaction trough 22 is sufficiently deep such that, when the trough plate 18 is affixed to the ground plane 14, a top edge 24 of the serpentine signal conductor 12 will coincide with a bottom 26 of the beam interaction trough 22.

Also, in the best presently known embodiment 10 of the present invention, a first coaxial feedthrough connector 28 and a second coaxial feedthrough connector 30 are provided. Each of the coaxial feedthrough connectors 28 and 30 has an outer conductor 31, an insulator 32 and an inner conductor 34. Note that the outer conductors 31 of the coaxial feedthrough connectors 28 and 30 can, alternatively, be made integral with the ground plane 14, if consideration is given to maintaining constant characteristic impedance through the feedthrough connectors 28 and 30. The inner conductors 34 of the first coaxial feedthrough connector 28 and the second coaxial feedthrough connector 30 connect to and support the ends of the serpentine signal conductor 12 at a first connection port 36 and a second connection port 38, respectively.

The best presently known embodiment 10 of the present invention also has two ground plates 40 which cover the serpentine channel 20 of the trough plate 18, leaving exposed the beam interaction trough 22 and those areas of the serpentine channel 20 which coincide therewith. The ground plates 40 are optionally provided, depending upon the application to which the shielded serpentine deflection structure 10 is applied, as will be discussed in more detail, hereinafter. A plurality (four are shown in the example of FIG. 1) of locating pins 42 fit into a like plurality of locating pin holes 44 in the ground plates 40, the trough plate 18 and the ground plane 14, for achieving the required alignment of the component parts of the shielded serpentine deflection structure 10. One skilled in the art will recognize that other locating means (not shown) might be used in combination with, or instead of, the locating pins 42 to achieve the necessary alignment.

Figure 2:
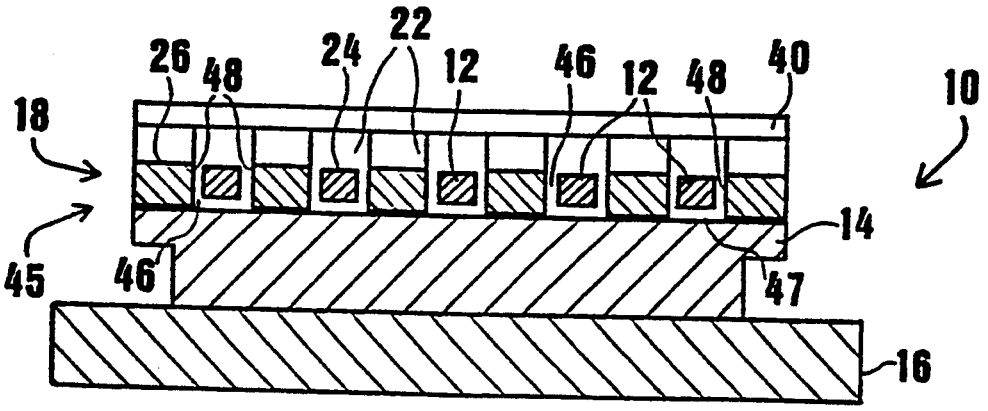
FIG. 2 is a cross sectional view, taken along line 2—2 of FIG. 1.

FIG. 2 is a cross sectional view, taken along line 2—2 of FIG. 1, of the assembled best presently known embodiment 10 of the present invention. In the view of FIG. 2 it can be seen that the serpentine signal conductor 12 does not touch any of the ground plane 14, the trough plate 18 or the ground plates 40, being supported only at the connection ports 36 and 38, as previously discussed, with respect to FIG. 1. Also in the view of FIG. 2 it can be seen that the top edge 24 of the serpentine signal conductor 12 is essentially even with the bottom 26 of the beam interaction trough 22, as previously discussed, herein. When assembled, as shown in the view of FIG. 2, the combination of the ground plane 14 and the trough plate 18 forms a channel structure 45 with a three sided channel groove 46 being formed by the ground plane 14 and the serpentine channel 20. The channel groove 46 has a channel bottom 47 and a pair of opposed channel sides 48. The channel groove 46 is capped, in the best presently known embodiment 10 of the present invention, by the ground plates 40.

Figure 3:
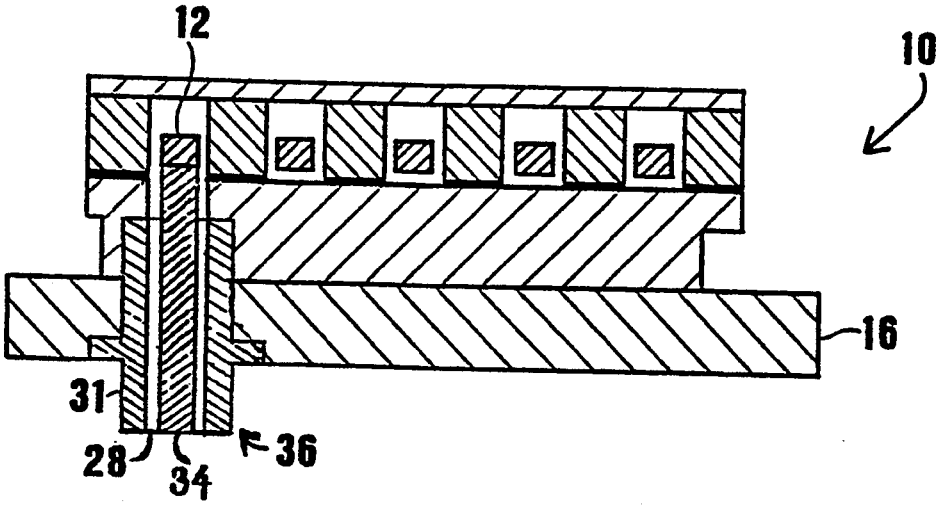
FIG. 3 is a cross sectional view, taken along line 3—3 of FIG. 1.

FIG. 3 is a cross sectional view, taken along line 3—3 of FIG. 1, of the assembled best presently known embodiment 10 of the present invention. The view of FIG. 3 intersects the first connection port 36 and shows the inner conductor 34 of the first coaxial feedthrough connector 28 affixed to the serpentine signal conductor 12, as previously described with respect to FIG. 1. As previously stated, the first coaxial feedthrough connector 28 and the second coaxial feedthrough connector 30 (not visible in the view of FIG. 3) are the only supporting members connected to the serpentine signal conductor 12, such that there is nothing touching the serpentine signal conductor 12 along its length which may cause capacitive or inductive coupling to the ground plane 14, the trough plate 18 or the ground plates 40, thus creating an impedance discontinuity. As can be seen in the view of FIG. 3, the serpentine signal conductor 12 approximates the size of the inner conductor 34 within the first coaxial feedthrough connector 28, such that impedance discontinuities are minimized at the junction of those components, as well. In the best presently known embodiment 10 of the present invention, the serpentine signal conductor 12 is welded to the inner conductor 34 of the first coaxial feedthrough connector 28, although soldering or other means of connection might also be used. Connection of the second coaxial feedthrough connector 30 to the serpentine signal conductor 12, which cannot be seen in the view of FIG. 3, is identical to that of the first coaxial feedthrough connector 28 to the serpentine signal conductor 12, which is depicted in the view of FIG. 3. It should be noted that the outer conductors 31 must be in good electrical contact with the ground plane 14 and may, in fact, be made integral therewith, as discussed previously, herein. In FIGS. 2 and 3, the inventive shielded serpentine deflection structure 10 has the base plate 16, as previously described in relation to FIG. 1.

Figure 4:
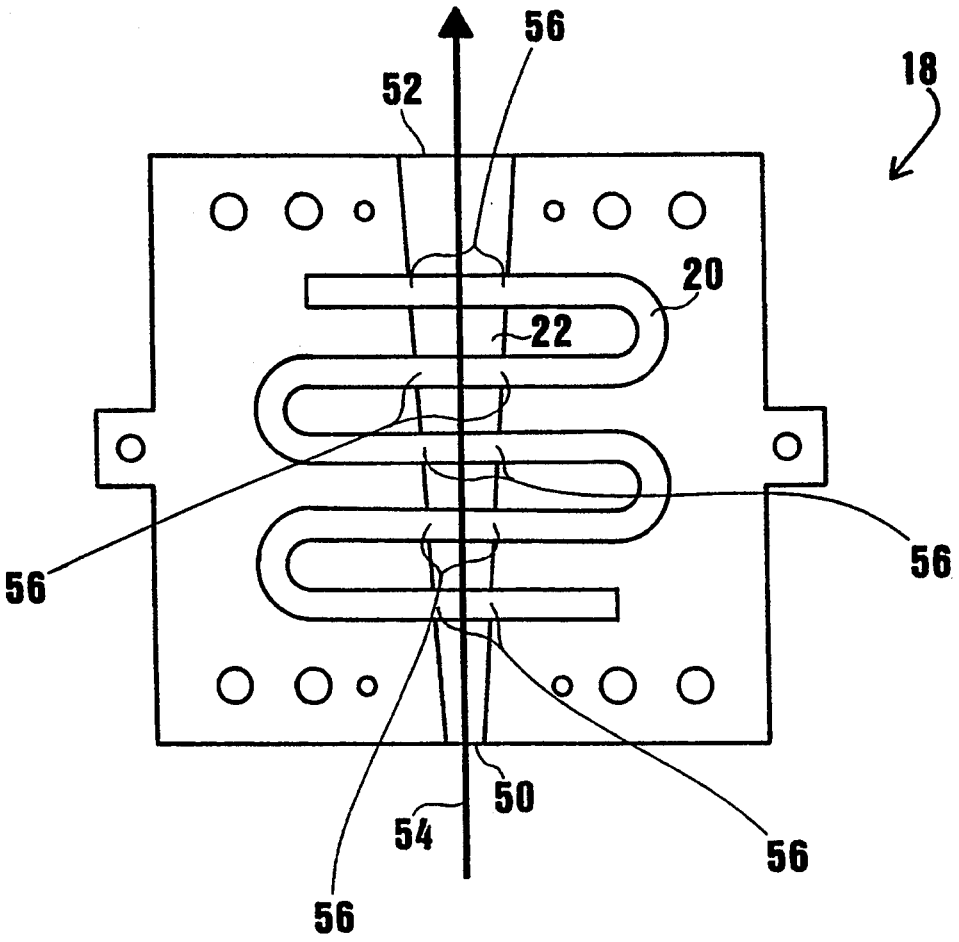
FIG. 4 is a top plan view of a trough plate, according to the present invention.

FIG. 4 is a top plan view of the trough plate 18 (as shown in FIG. 1). It can be seen in the view of FIG. 4 that a beam entry end 50 of the beam interaction trough 22 is more narrow than a beam exit end 52 thereof, such that a horizontally deflected electron beam 54 passing therethrough can be deflected vertically by the inventive shielded serpentine deflection structure 10. Alternatively, recent experiments have revealed that the beam interaction trough 22 need not be tapered, as long as it is wide enough to accept the neceesary deflection of the electron beam 54. The electron beam 54 passing through the beam interaction trough 22 is deflected by the serpentine signal conductor 12 (FIG. 1) at a plurality (five in the example of FIG. 1) of beam interaction regions 56, where the serpentine channel 20 intersects the beam interaction trough 22, such that the electron beam may be deflected when it passes thereby.

Various modifications may be made to the invention without altering its value or scope. For example, the channel structure 45 (FIG. 2) may be formed from a single piece of metal with the channel groove 46 (FIG. 2) machined therein.

All of the above are only some of the examples of available embodiments of the present invention. Those skilled in the art will readily observe that numerous other modifications and alterations may be made without departing from the spirit and scope of the invention. Accordingly, the above disclosure is not intended as limiting and the appended claims are to be interpreted as encompassing the entire scope of the invention.

INDUSTRIAL APPLICABILITY

The shielded serpentine deflection structure 10 is intended to replace conventional slow wave deflection structures in high bandwidth oscilloscopes and other devices wherein it is desired to provide high frequency deflection of an electron beam. The shielded serpentine deflection structure 10 of the present invention may be substituted in such devices for conventional slow wave deflection structures.

The inventive shielded serpentine deflection structure can be used either in vacuum or non-vacuum environments, although the usage in non-vacuum environments is considerably limited by the scattering of electrons by molecules in the path of the electron beam 54. Where the usage is in a vacuum environment, the dielectric between the serpentine conductor 12 and the channel groove 46 is vacuum. In other usages, the dielectric is air.

It is well known in the art to deflect electron beams by a single slow wave deflection device, in an unbalanced mode (with an opposing grounding plane opposed across the electron beam therefrom), or in mirror image pairs, in a balanced mode. The best presently known embodiment 10 of the present invention, as described herein, is intended for use in mirror image pairs for balanced mode operation, although one skilled in the art can easily adapt it for unbalanced mode operation by removing the ground plates 40 and substituting an opposing ground plane (not shown), in like manner as is done with conventional slow wave devices in such applications.

A particular advantage of the present invention is that, although the characteristic impedance of the transmission line (consisting of the serpentine signal conductor 12, the ground plane 14, the trough plate 18 and the ground plates 40 in the best presently known embodiment 10 of the present invention) is subject to changes in characteristic impedance where the line is bent (as with conventional conductors), such changes in impedance, in the present invention, may be compensated for by subtle changes in the cross-section of either the serpentine signal conductor 12 or in the channel groove 46. The type and amount of alteration necessary is driven by the degree of impedance difference, and whether such difference is caused by inductive or capacitive deviations. The design of the present inventive shielded serpentine deflection structure 10 enables local corrections to be made to the dimensions by simple alterations of machine tool programming, without retooling or resorting to the manufacture of expensive customized subassemblies.

The shielded serpentine deflection structure 10 may be utilized in any application wherein conventional slow wave devices are used, and will provide the elimination of fast forward coupling and discontinuities, thus preventing precursor artifacts and improving signal resolution. Therefore, it is expected that it will be acceptable in the field as a substitute for the conventional slow wave devices. For these and other reasons, it is expected that the utility and industrial applicability of the invention will be both significant in scope and long-lasting in duration.

We claim:

1. A slow wave deflection device for deflecting an electron beam, comprising:

a serpentine conductive element having ends;

a channel structure having a serpentine groove therein, the groove being disposed in said channel structure such that said conductive element fits within the groove without touching the groove at a bottom and further without touching at either of a pair of opposing sides of the groove;

support means for supporting said conductive element at the ends of said conductive element such that said conductive element is supported within the groove without touching the groove at either the bottom thereof and further without touching at the sides thereof; and electrical feedthrough means electrically connected to said conductive element at the ends of said conductive element for passing an electrical signal therethrough; wherein said channel structure is comprised of a combination of a ground plane block and a trough plate, the trough plate being a generally flat plate with a serpentine channel disposed therethrough such that when the trough plate is positioned on the ground plane block the serpentine groove is defined with the bottom of the groove being a portion of the ground plane block and the sides of the groove being defined by the channel in the trough plate.

2. The slow wave deflection device of claim 1, wherein:

said support means and said electrical feedthrough means are a coaxial feedthrough device having an insulator and an inner conductor, the insulator being inserted within a feedthrough hole in said channel structure and the inner conductor being affixed to the ends of said serpentine conductive element such that said serpentine conductive element is supported by said feedthrough device and further wherein electrical signals are provided to said serpentine conductive element through the inner conductor of the coaxial feedthrough device.

3. The slow wave deflection device of claim 1, and further including:

a beam interaction trough, the beam interaction trough being an elongated recession in said channel structure which intersects the groove at a plurality of beam interaction regions, wherein when the electron beam travels along the beam interaction trough said electron beam crosses said serpentine conductive element at the beam interaction regions.

4. The slow wave deflection device of claim 3, and further including:

a plurality of ground plates, the ground plates covering the serpentine groove in said channel structure except that the beam interaction trough is not covered thereby.

5. The slow wave deflection device of claim 3, wherein:

the beam interaction trough is sufficiently deep such that a bottom of the beam interaction trough coincides in height with a top of the serpentine conductive element.

6. An electron beam deflection means for a traveling wave cathode ray tube, comprising:

a rigid serpentine conductor, said serpentine conductor being positioned such that said serpentine conductor intersects a path of the electron beam at a plurality of beam interaction regions;

a solid channel block having a groove therein with said serpentine conductor fitted within the groove such that said serpentine conductor is enclosed on at least three sides by the groove of the solid channel block; and support means connected to the ends of said serpentine conductor for supporting said serpentine conductor within the groove; wherein the groove in said channel block is substantially covered by at least one ground plate.

7. The electron beam deflection means of claim 6, wherein:

the channel block has a surface; and said channel block has an electron beam trough disposed therein for passing the electron beam therethrough, the electron beam trough being an elongated recession in the surface of the channel block which intersects the groove in said channel block at each of the beam interaction regions.

8. The electron beam deflection means of claim 6, wherein:

an electrical connection is made to said serpentine conductor through said support means.

9. A serpentine slow wave deflection structure for deflecting an electron beam in a traveling wave cathode ray tube, comprising:

a ground block with a serpentine groove formed therein, the serpentine groove being an elongated serpentine recess in a surface of the ground block; and a signal conductor, said signal conductor being disposed so as to fit within the serpentine groove such that said signal conductor generally follows the path of the serpentine groove, said signal conductor further being sufficiently small in cross section such that said signal conductor fits within the serpentine groove without touching the ground block;

a beam path, the beam path being a generally straight elongated recession in said ground block which intersects the serpentine groove, wherein when the electron beam is projected along the beam path, the electron beam passes by the signal conductor at a plurality of beam interaction regions;

at least one ground plate comprising a top in contact with said ground block for enclosing said signal conductor within the serpentine groove; wherein the ground plates are spaced apart so as to expose the beam path such that the beam interaction areas are not covered by the ground plates.

10. The serpentine slow wave deflection structure of claim 9, and further including:

electrical feedthrough means for providing an electrical signal to said signal conductor, wherein in response to said electrical signal the electron beam is deflected thereby.

11. The serpentine slow wave deflection structure of claim 9, wherein:

an electrical feedthrough means supports said signal conductor at a pair of ends of said signal conductor.

12. The serpentine slow wave deflection structure of claim 9, wherein:

said signal conductor is rigid and has ends and further is supported at the ends of said signal conductor such that there is no contact between said signal conductor and a bottom of the serpentine groove and further such that there is no contact between said signal conductor and either of a pair of sides of the serpentine groove.

13. The serpentine slow wave deflection structure of claim 9, wherein:

the beam path has a depth such that a bottom thereof coincides in height with a top of the signal conductor.

* * * * *